US011272766B2

(12) United States Patent
Rossini

(10) Patent No.: US 11,272,766 B2
(45) Date of Patent: Mar. 15, 2022

(54) REGULATING SYSTEM FOR RINGS

(71) Applicant: STILNOVO S.R.L, San Salvatore Monferrato (CH)

(72) Inventor: Adelio Rossini, Bmsino Arsizio (CH)

( * ) Notice: Subject to any disclaimer, the term of this patent is extended or adjusted under 35 U.S.C. 154(b) by 0 days.

(21) Appl. No.: 16/645,516

(22) PCT Filed: Sep. 18, 2018

(86) PCT No.: PCT/IB2018/057178
§ 371 (c)(1),
(2) Date: Mar. 9, 2020

(87) PCT Pub. No.: WO2019/053691
PCT Pub. Date: Mar. 21, 2019

(65) Prior Publication Data

US 2020/0288826 A1 Sep. 17, 2020

(30) Foreign Application Priority Data

Sep. 18, 2017 (IT) ..... 102017000104245

(51) Int. Cl.
*A44C 9/02* (2006.01)

(52) U.S. Cl.
CPC ..... *A44C 9/02* (2013.01)

(58) Field of Classification Search
CPC ..... A44C 9/02
USPC ..... 63/15.5, 15.6, 15.65
See application file for complete search history.

(56) References Cited

U.S. PATENT DOCUMENTS

| | | | | | |
|---|---|---|---|---|---|
| 1,442,738 | A * | 1/1923 | Seeler | A44C 9/02 | 63/15.6 |
| 2,055,315 | A * | 9/1936 | Sessa | A44C 9/02 | 63/15.6 |
| 2,146,272 | A * | 2/1939 | Skoog | A44C 9/02 | 63/15.65 |
| 3,028,736 | A * | 4/1962 | Kahre | A44C 9/02 | 63/15.2 |
| 3,460,356 | A * | 8/1969 | Lodrini | A44C 9/02 | 63/15.6 |
| 3,933,010 | A * | 1/1976 | Ulbrich | A44C 9/02 | 63/15.6 |
| 5,261,256 | A * | 11/1993 | Ellenbecker | A44C 9/02 | 63/15.5 |
| 2010/0083701 | A1* | 4/2010 | Huynh | A44C 9/02 | 63/15.6 |

FOREIGN PATENT DOCUMENTS

| | | | |
|---|---|---|---|
| CN | 104665132 | B | 3/2016 |
| JP | H056521 | U | 8/1993 |
| WO | 2010132034 | A1 | 11/2010 |

* cited by examiner

*Primary Examiner* — Jack W Lavinder
(74) *Attorney, Agent, or Firm* — Rumit Ranjit Kanakia

(57) ABSTRACT

The present invention refers to the field of precious objects, and in particular to the field of goldsmithing, jewelery, with particular reference to rings. It should be noted that the present invention can also refer to the field of bijoux or the like. Particularly interesting for the present invention are the rings and the problem of their measures.

8 Claims, 3 Drawing Sheets

REGULATING SYSTEM FOR RINGS

FIELD OF INVENTION

The present invention refers to the field of precious objects, and in particular to the field of goldsmithing, jewelry, with particular reference to rings. It is to be noted that the present invention may also refer to the field of bijoux or the like. With reference to the rings, here the object of reference for the present invention, it is well known that these precious (or less) objects have always been the most difficult to choose, to present and to wear for long periods of time, as unlike most other jewelry objects (e.g., earrings, necklaces, bracelets), precious or not, the rings have very specific sizes that, besides being very variable from person to person, are also variable for an individual, because the dimensions, circumference or size of the finger as may be defined, not only varies depending on the finger on which it is worn, but it also varies in the course of the time, even quickly, along with the variation, for example, of the weight of the user, in fact, increasing or decreasing in weight for the most varied reasons, the diameter of the fingers varies rapidly and also in a relevant way, this obviously influences the size of the rings; also a significant factor can be the change of season, in fact heat tends as it is known to inflate the fingers, the passage of time can also be a further factor of influence in this regard, etc.

Often the rings in particular are considered among the most symbolic jewels (engagement, marriage, symbolic pledge, special memory, university degree, communion, birthday, etc.) so they are also to be considered among the jewels that have or are given more value, so it is of fundamental importance to be able to wear them for as long as the user thinks fit.

STATE OF THE ART

In particular, there are rings that are adjustable namely not formed or consist of a profile or closed circumference, such as typically a circle, or even for some rings a square or similar geometric figure, which are adjustable because two sides overlap but usually this solution is not applicable to rings of value since the materials are difficult to handle with bare hands, and also tend to be ruined when continuously manipulated. Typically, a ring of value, preferably circular or similar in shape, with a thin or more or less wide band always entails the problems mentioned above.

Consequently, it is well known to ask for a change in size of a ring for various reasons, which unfortunately is not always possible, without ruining or distorting the appearance of the ring in question. Changing the size of a ring has always been a more or less big problem for the jeweler. To widen or to decrease a size means traditionally to cut the stem, in the part that is under the finger when the object is worn, to add or to remove a part of metal.

When it comes to a ring embedded throughout its surface, then it becomes difficult and very expensive to widen or tighten even just one size: there is nothing left to do than stock/store of the most common sizes, this is with regard to possible replacement for a new ring, but with regard to longstanding rings often enriched with special stones or particular workmanship a change of size or maintaining a "stock" is not always possible.

To date, to overcome this problem, several solutions have been proposed, some of which are particularly valid, including a solution proposed in 2011 by the applicant himself, who is here considered the closest prior art to the present invention that will be described below; the present invention is therefore intended to be an invention of improvement as will be clear from this description. With reference to the prior art, an example of a solution known for a long time, includes a cut of the ring, (as already mentioned) where possible, interposing suitable material for the purpose by means of welding or similar, such solution turns out however often not feasible, it can lead to not always aesthetically pleasant results, it can ruin even the aesthetics of the object if the required specialized manpower does not succeed carrying out an adequate job and moreover such solution carries risks for the jewels, it carries often high costs and does not guarantee an optimal result.

Further examples of known art designed to find a solution to the problem described above, is for example the so called multi-size ring that includes tiny and invisible springs hidden inside the ring to allow the ring to adapt at least partially to the size of the finger; such solution as said by the inventor himself, guarantees a tolerance of 1 maximum 2 sizes. This tolerance may be sufficient, for example, to allow the ring to be moved from one finger to another, but, as is known by experts in the field, this range confers a relatively low margin of adaptability, as over time the fingers may undergo much more important circumferential alterations, usually evaluated between two and four sizes at least, this simply for variations in weight, changes in the knuckles due to age, or other very common reasons.

Furthermore, the proposed solution may not be perfectly safe because, if the springs were to come loose or broken over time, the ring could easily slip and fall off the finger. The realization with steel springs inside the structure makes the realization of the same rather expensive, and in case of size variations of +/−two sizes the ring is no longer modified in any way unless it is completely remade, this obviously with great economic expenditure and as long as this operation is possible, which depends on the type of ring.

Again, this solution could be sometimes bothersome to the wearer of the ring, in fact the springs could tighten the finger, bothering the user, this solution must be well calibrated, even better customized, and this is not possible in this case, and still the wear of the springs could make the adjustment of the size in the long run unfeasible.

A further device proposed for this purpose is described by some fine jewelers who offer a range of rings (or bracelets) including a spring mechanism; the elements of the ring, here preferably stones, are joined together and mounted on individual elastic elements forming a ring consisting of small sectors of circular crown, in this case seen in 3D, cylindrical segments, each comprising on the outer surface one or more stones.

This solution is very expensive and laborious for the expert, an aspect usually masked by the value of the object itself, however, disadvantageously, even in this case it is extremely important to calibrate the elastic force with which the ring as a whole is tightened to the finger, which can be annoying if the finger swells and the elastic force exerted is excessive, so allowing an expansion of the ring but exerting too much compression on the finger, with a "loop" effect. Again, in a further disadvantageous way, if the circumference were to expand beyond a certain limit, the ring would be aesthetically damaged because the various cylindrical segments would be spaced between them, highlighting the structure of the ring, which is not very pleasant from the point of view of visual appearance, especially for a jewel of value.

Moreover, this solution is only applicable to rings made entirely of stones on the whole circumference, otherwise the various sectors would be immediately visible and not masked by stones, resulting extremely unpleasant.

Finally, in an extremely disadvantageous way, in case of wear of the elastic mechanism, the ring would no longer be usable.

Basically, as said, the most common alternative to enlarge or tighten a ring (i.e. the machining by a goldsmith on the piece) brings with it problems the more you have to change the size. There is a risk of changing the shape of the ring and, much more serious, there is a risk of making any recess unsafe: changing the curvature of the ring inevitably changes the seat of diamonds or precious stones, an event that compromises the reliability of the "seal" of the same.

In any case, it is advisable to widen or tighten a maximum of 2 sizes, especially in the case of rings embedded with precious stones.

Again, a well-known example of prior art is described in KR 2009 0020438, which describes an annular structure comprising a ring having in a part of a circular sector in the upper part of the same an recess made in which it is housed an element in the shape of a circular crown with elastic characteristics, in the central part of that crown element being fixed a screw connected in turn to the ring, screwing and unscrewing that screw changes the internal size of the ring. It seems evident how such solution disadvantageously compromises the ring itself, inasmuch it must be a purposely realized ring, with a screw, a solution not much appreciated aesthetically, above all in case of precious rings, still such solution allows the modification of few sizes only, moreover, if the measure were regulated on the "narrow" between the external hull of the ring and the inner structure remains a crack of relief, this causing an imbalance in the ring itself, that results eccentric, as the circularity and concentricity of the sealing element and the ring itself no longer correspond, causing discomfort to the user, as well as potentially being a receptacle for dirt and easily attached to objects causing extreme discomfort and damage. Moreover, it is necessary to buy such an object already imagining future changes in size, this making it unpleasant to the eye even at the time of purchase, as they are often valuable objects, that is certainly not negligible. Furthermore, over time the screw mechanism may lose its seal due to wear, which can cause annoyance to the wearer, impossibility of wearing it, loss of the object and/or need for continuous maintenance with considerable economic burden.

The same problems can be found in document GB 22 98 564, which describes an annular structure comprising a housing or a hull in a circular sector in the lower inner part, in which internal structures can be inserted with an essentially annular "C" shape open on one upper side, depending on the diameter of the finger an internal structure is chosen that is fixed in the hull by squeezing the lower side walls of the ring to secure it in the same. This document has all the disadvantages described with reference to the Korean document, it is also noted that, the C-shaped structure lends itself even more to entanglement with surrounding objects, the ring remaining constantly unbalanced, and again, disadvantageously, having to tighten by crushing/stretching the inner element with the ring to keep it firm, it is always required the intervention of a jeweler for such modification, with consequent inconvenience and various costs, as well as causing wear of the ring itself.

Finally, document JP H05 65214 describes an external annular structure comprising in at least part of its inner side, in the lower part of the ring, a circular sector in which a hollow hull is made to house a reducer element having the form of a sector of circular crown substantially semi-circular, it appears that this element is fixed during the purchase in the ring to adapt the same to a finger size, even in this case disadvantageously to change the size it appears necessary to turn to the jeweler, the ring being eccentric compared to the internal seal element, unbalancing the same and again the changes to the size may be very limited.

In each of the three cases described above, the external structure of the ring when the reducer is present in an extremely disadvantageous way is not balanced with respect to the user's finger and is not flush with the finger, this causing permanent discomfort to the user, the ring not being balanced can easily rotate around the finger and also is not centered on the finger, with a completely unpleasant and uncomfortable effect in addition to the other numerous disadvantages mentioned.

Finally, it should be noted that the pleasing to the eye factor is decidedly relevant in the context of precious objects in themselves, as it greatly affects the sale, in such a way that it is not a negligible factor in the technical construction of the object, in these cases the user would buy an object a priori not in its "best" form including considerable inconvenience and disadvantages, this seems obviously to have a very harmful effect on sales.

Referring now to the solution proposed previously by the applicant subject to an Italian patent granted, in particular filed in 2008, this advantageous technical solution involved the creation of a ring with inside it a sheath or an excavation of a shape suitable for the insertion of a spring element comprising a laminar core to which a series of transversal segments are bound; this sheath can be removed from the hull by means of a special instrument with a tip, called "key" in the sector; in particular, it is possible to make this device in various sizes and in an extremely advantageous way and unlike the mentioned previously known art, it will be possible to vary the size of a ring up to four sizes, a result that is more than sufficient to adapt to any variation in the diameter of the finger needed in the average life of a single person. In particular, this solution was particularly advantageous, in economic terms, as this solution is suitable for substantially all types of rings, with or without precious stones. Again, this solution allows a significant reduction in the stock of rings in various sizes, resulting in considerable savings by the jeweler. In a further advantageous way, in the event that this spring breaks or deteriorates over time, it is always possible to replace it without changing in any way the ring itself, so allowing further economic savings by the user. Furthermore, the versatility in terms of size allows the user to always have a ring with a perfect fit, neither too narrow nor too wide. Furthermore, the original ring is preserved from the passage of time, since the part in contact with the user's finger is the spring and not the body of the ring itself. All these advantages make this solution an extremely advantageous solution and suitable to solve, among others, the prior art problems mentioned above, but there are some disadvantages that distinguish this solution, including the fact that the spring is composed of two and more parts, including internal teeth, facing a special housing made in the ring, and internal segment/paths facing the finger, in contact with it, as well as a laminar core housed between these two layers of teeth. Such spring has a complex realization for which it turns out to be rather expensive, still, in disadvantageous way, the complexity of such a spring structure, even if advantageous allowing to realize all the advantageous purposes above mentioned, is overall, considering the overall weight of the annular structure inclusive of spring, decidedly heavy, that is the added weight to the ring in itself and rather relevant and this obviously can cause annoyance to the user.

Furthermore, the core of the spring is usually made of a flexible material such as metal and in particular steel, over time, since these springs are precisely designed to last a very long time, there is a risk that parts of the spring not made of gold or precious metals will undergo oxidation, corrosion, etc., this limiting the life time, to the disadvantage of the customer who is forced in case to buy again a part of the ring because of wear. Furthermore, any metal part could lead in the long run to problems of metal allergy by a particularly sensitive user, and given that a ring, especially one of value or of particular sentimental value (see: a wedding ring) is destined to be always worn, such problems could prove to be decidedly relevant.

Furthermore, as a whole, the spring, considering its articulated structure, is destined to have a certain aesthetic impact on the ring, something that is potentially unwelcome to the end user. Note that, unlike the aforementioned known devices, in this case the aesthetic impact is well reduced, however it may not be fully appreciated.

Again, this solution in a completely advantageous way in each case maintains the original aesthetic shape of the ring, and the perfect concentricity between the inner element and the ring.

The purpose of the present invention is therefore to maintain all the advantages obtained by the invention previously patented by the applicant, but to solve the problems highlighted above.

In particular, the present invention has among its purposes also those of solving the problems of the prior art as mentioned above.

It is therefore a purpose of this invention to propose a solution for the adjustment of the size of a ring that allows a modification up to ⅘ sizes.

One purpose of this invention is to describe a regulating system for rings that allows to always have the finger perfectly seated in the ring itself.

It is a further purpose of this invention to describe a ring regulating system that keeps the ring in the correct position, i.e. fit balanced with respect to its original shape.

It is still a purpose of the present invention to propose a totally hypoallergenic regulating device.

In addition, it is a purpose of this invention to describe a ring regulating system that is good value for money for the ring to which it relates, so one purpose is to contain production and sales costs.

Again, it is a purpose of the present invention to describe a lightweight and space-saving ring regulating system.

It is also a purpose of this invention to describe a device and system suitable to be applied or realized for substantially any type of closed profile ring.

Finally, it is a purpose of the present invention to describe a simple and performing device and regulating system that will last for a long time.

It is a purpose of this invention to describe a regulating system for rings that allows the modification of the size even by the user himself without the need for the jeweler.

BRIEF DESCRIPTION OF THE INVENTION

These and other purposes will be achieved by means of the innovative regulating system for rings described in the present invention, which essentially comprises at least one outer annular structure with substantially circular shape, comprising at least one groove formed preferably for most of the length of the inner circumference of the ring and at least one or a plurality of internal calibrating devices substantially with shape of a circular crown portion substantially realized in one piece, with a diameter substantially equal to or less than the external diameter of the substantially circular structure, said device being adapted to engage by interlocking in the groove or housing internally realized in said annular structure, said one or more devices having different degrees of curvature and bending or jumble on the inside part of said devices (namely the part towards the finger) which modify the thickness of said device to modify the size of the annular structure, said one or more devices being advantageously interchangeable between them.

In a further advantageous manner, such a device may include at least one or more carvings to provide additional flexibility to the device.

In a particularly advantageous way said device surrounds the finger basically completely, said device being always perfectly concentric with the internal annular structure, this allows in a particularly innovative and advantageous way to always keep the finger correctly and comfortably housed in the calibrating device and consequently in the annular structure, the system fitting perfectly on the user's finger and the ring being correctly worn maintaining stability and the correct balance (there is no longer the serious disadvantage mentioned with reference to the prior art, that is the system is concentric so the balance of the ring with respect to the finger is advantageously always maintained). In essence, in a particularly advantageous way, the circumference of the finger is always equidistant from that of the outer annular structure, as well as from the calibrating device.

In a still more advantageous way, this device includes at least one hole suitable for inserting an instrument, such as a suitable hook, in particular as defined in the sector a 'key', to easily extract the sheath or calibrating device from the housing of the annular structure. (It is to be noted that in an even more advantageous way, it is sufficient also to use a means with a suitable tip for the purpose if the appropriate hook is not available, to the benefit of the user.) In this way the user can comfortably change the calibrating device at home, effortlessly, and without time or economic expenditure.

In an even more advantageous way, said sheath or calibrating device is made in a single piece, in hypoallergenic material, such as gold, and including said slots suitable to make it particularly flexible and handy. It is immediately noticeable that this sheath is much simpler to produce than the spring proposed by the prior art, which is also advantageously totally free of oxidisable or perishable or allergenic parts and which, even more advantageously, as well as being structurally simple, is much lighter, this to the benefit of the cost of the system proposed here allowing therefore to propose to a wider range of customers and also to the benefit of the quality of the final result in terms of finished product, which is much lighter and more pleasant to wear for the user. Furthermore, in a further advantageous way, in the event of deterioration, breakage or loss of one of these sheaths, it will always be possible for the user to re-purchase it without incurring excessive costs in this case, since only part of the ring is involved.

In a further advantageous way, it immediately appears evident how this solution solves the prior art problems mentioned above, as it is a solution suitable for any type of ring structure whether smooth, as a wedding ring for example, a product of great impact in this area, or more elaborated, as a ring with one or more stones, or totally covered with stones.

Again, unlike the prior art, this solution does not change in any way the aesthetics of the ring, so the same maintains the original features of pleasantness needed to appease the purchase by the end user.

Furthermore, there is no residual space between the internal calibrating device and the external annular structure, so that the problem mentioned above of the possibility of the ring becoming entangled, damaging various objects (pullovers, sweaters, etc.), causing discomfort and potentially accumulating dirt in these cracks, is completely solved.

Moreover, in this case the life time of the ring is not negatively affected by an enlargement/shrinkage system, since although forming a single system, the two parts annular structure and sheath are separately produced objects, so as already mentioned, the sheaths are advantageously separate and easily replaceable.

Finally, there is no danger of bothering the user's finger since the sheath does not hold the finger in any way and the great versatility in the size of the same and ease of replacement makes it possible to always have the perfect fit for the ring.

BRIEF DESCRIPTION OF THE FIGURES

These and other purposes and advantages achieved by the regulating system for rings described in the present invention will be further clarified by means of the description of the attached figures in which.

DETAILED DESCRIPTION OF THE FIGURES

Figure 1:
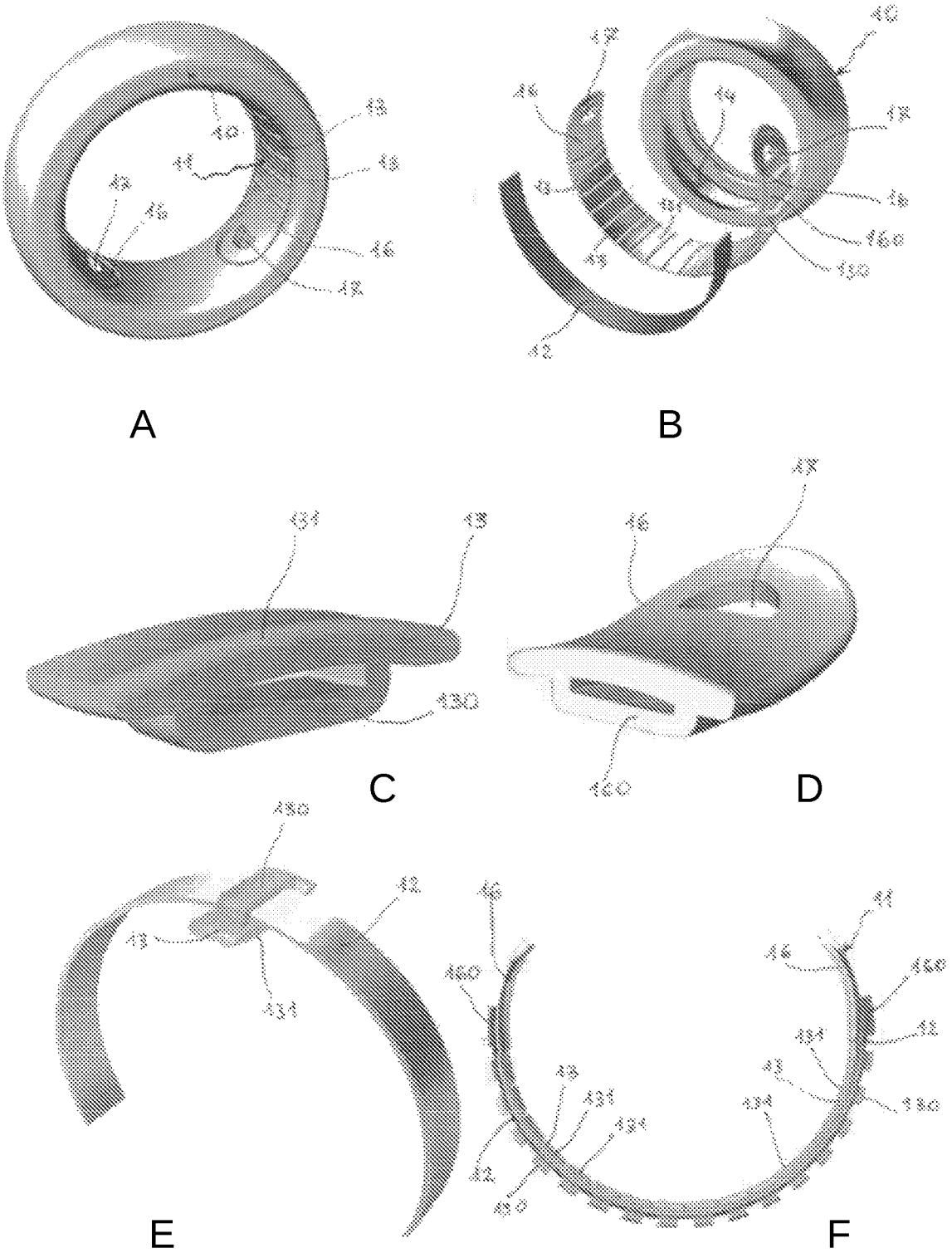
FIG. 1 shows an excerpt from some figures representing the cited patent owned by the applicant, of which the present invention is a new and inventive technical improvement.

With reference now to FIG. 1, a set of figures A, B, C, D, E, F has been grouped together, which are not intended to be described herein but which are representative of the patent of the applicant referred to here for the present patent application, the present invention being an innovative improvement of the solution, however new and inventive, proposed previously by the applicant. The detail of the advantages and implementation of such a solution has been discussed here previously with reference to the known art, so here we simply point out that: in FIG. 1A a ring including the spring described by the invention is visible, in FIG. 1B the various components of this spring are clearly visible in exploded view, in particular with reference to the core 12 and to the whole of the transversal segments 13 and in FIGS. 1 C, D, E, F the various components of the spring are visible, including the single transversal segments 131 with increasing convexity that are assembled in an extremely uncomfortable way one by one, on the core 12 and that must be replaced to change the size of the ring, and again a terminal part 16 to block the core and the segments inserted there. It is immediately evident that this spring is extremely complex to produce and assemble, also the accumulation of parts on top of each other as it is evident greatly increases the weight and even the price as this structure also consists of precious metals, so making it accessible as a technical solution, including disadvantages and advantages, only to customers with a high budget available, this can be disadvantageous for a retailer who wants to have such a product given the costs.

It should be noted that from now on the numbering will start again ex novo, the one mentioned with reference to FIG. 1 has been maintained for clarity of reference to the known art figure.

Figure 2:
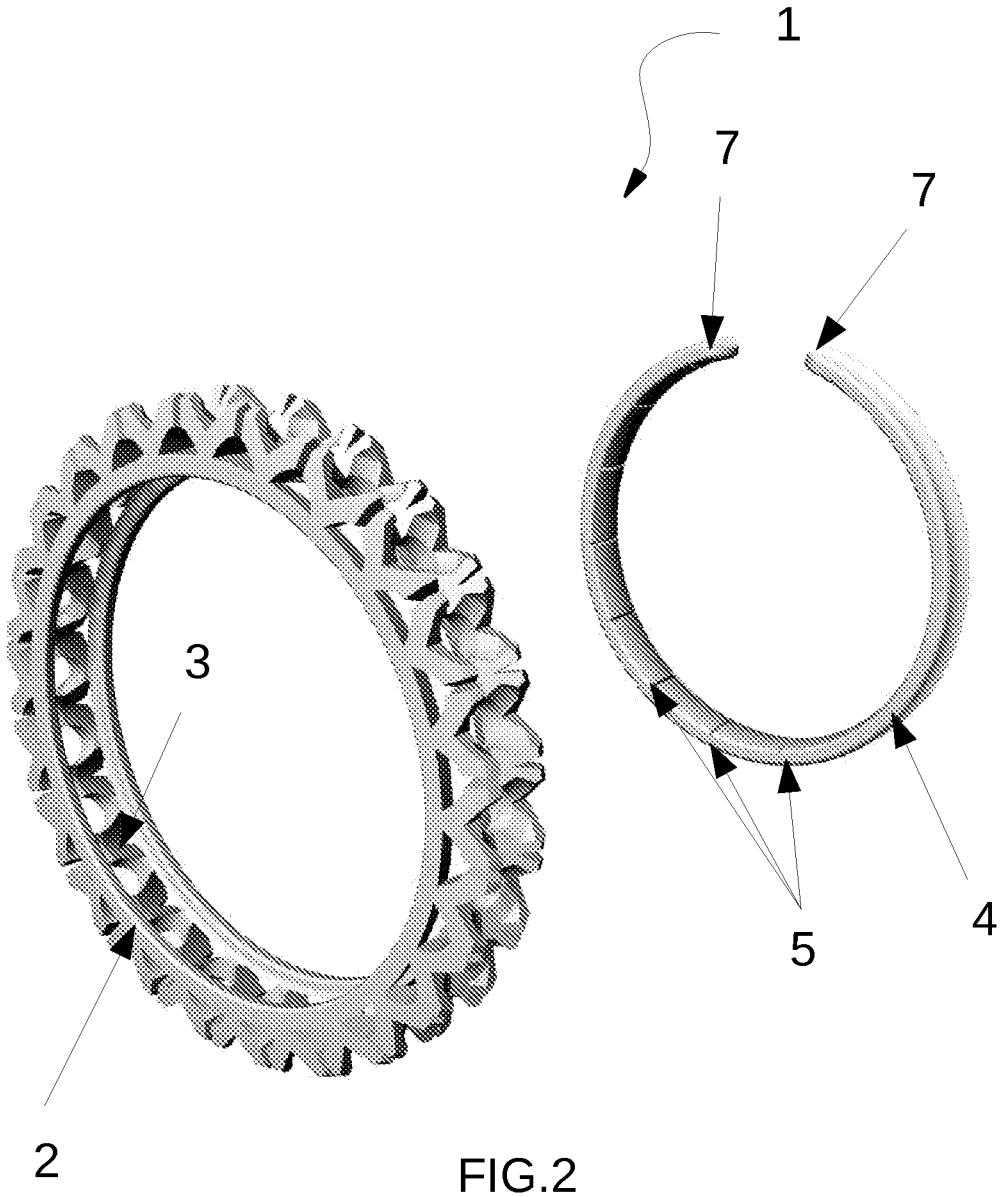
FIG. 2 shows a first preferred form of representation of the regulating system for rings described by the present invention in which the two parts of the system are separated from each other.

With reference to FIG. 2, a particularly preferred initial form of implementation of the innovative regulating system 1 for rings described in the present invention is represented, which includes in its present form at least one annular structure 2, essentially preferably in the form of a circular crown, in which a groove or housing 3, covering the entire inner circumference of the annular structure 2, is made; said system further includes at least one or more calibrating devices which can be housed in groove 3, for example, by interlocking. As shown in FIG. 1 said device 4 (here is represented one to represent each of them) is essentially shaped as a portion of a circular crown, almost complete, and/or or substantially closed, or of a circular crown including a crack to allow the easy insertion and removal from the annular structure with simplicity, said device 4 being particularly advantageously eccentric compared to said annular structure 2, maintaining the proper balance and positioning of the ring on the finger, said device 4 wrapping completely or for the most part, the circumference of the finger.

Note that obviously, if the ring is smooth, or without stones, it will be possible to accommodate the device 4 in all the groove that will be made in the outer annular structure 2, this groove will run substantially around the circumference of the ring. In any case, advantageously, even if the ring has stones, as here realized, remaining the device 4 completely housed in the groove 3, having however circumference suitable to maintain the eccentricity of the same with respect to the external structure, it also ensures that the circumference of the finger is always equidistant from the circumference of the ring.

Said device 4 having a diameter substantially equal to, or less than, said annular structure 2, said calibrating device (each of several of them) shall comprise a number of slots 5 spaced by default and made in the direction of the thickness S of the calibrating device 4 in order to give this device flexibility.

Figure 3:
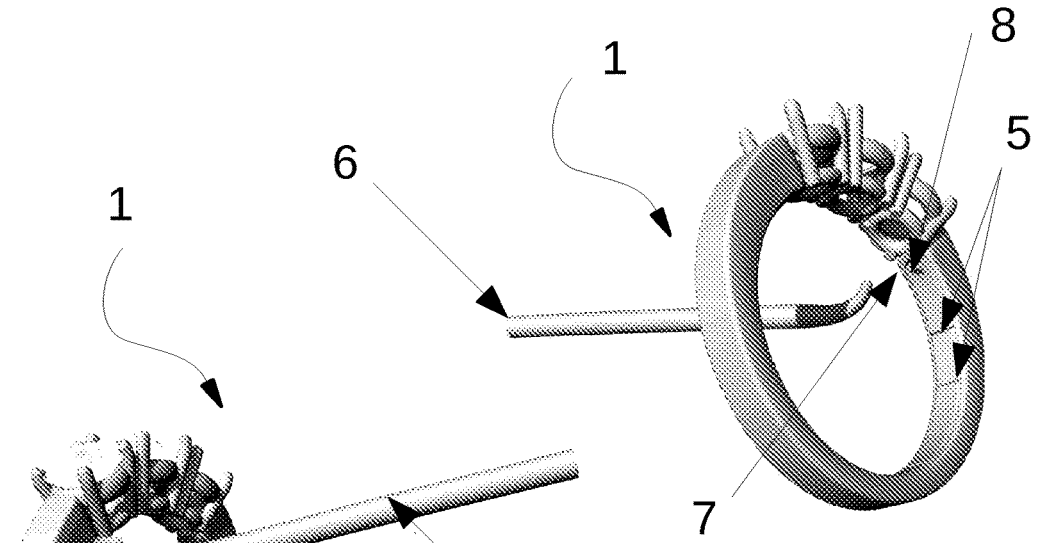
FIG. 3 shows the same preferred design form in which a calibrating device is housed in the annular structure.

Said device, as shown in detail in FIG. 3,4,5, is suitable for accommodating by interlocking and elastical forcing in said housing 3 and remains in place by interlocking and elastical forcing, its flexible structure allows to force them elastically to be comfortably inserted into housing 3 of the annular structure; once inserted it divaricates by returning elastic in the retaining rail formed by said housing 3 and remains in place by interlocking.

It should be noted that advantageously between said calibrating device and said annular structure there is no residual space or cracking, the calibrating device is completely housed in the annular structure, thus resolving the correlated prior art problems before mentioned.

Figure 5:
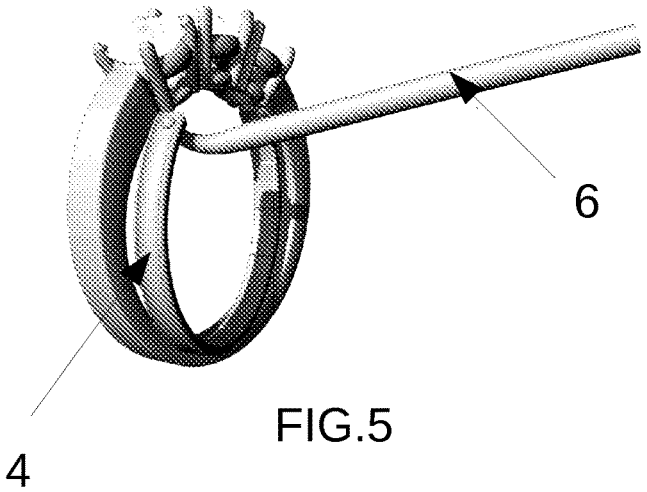
FIGS. 4 and 5 show two views of a phase of removing a calibrating device from an annular structure.
Figure 4:
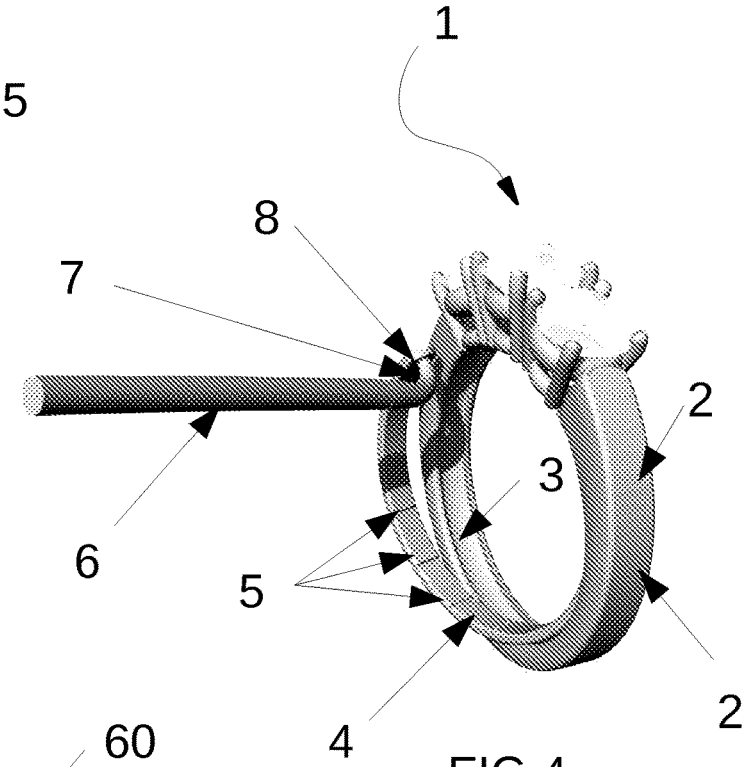
Figure 6:
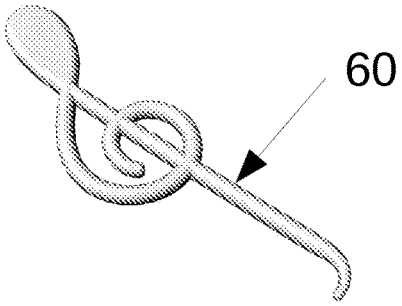
FIG. 6 is an example of a further preferred form of making a hook suitable for the purpose of this invention that could be part of a kit for such a system.

This device 4 can be easily removed from this housing 3 (FIG. 4,5) by means of a special hook 6, which can be of various shapes, such as for example the one shown in FIG. 5 where a hook 60 is represented having the pleasant shape of a violin key, and more comfortable to hold than the base hook 6.

It should be noted in that regard that said device includes at least at one of its terminal ends a hole 8 or a similar housing, suitable for inserting the tip of a hook 6 or an instrument suitable for performing that function (if necessary, any instrument with a tip of a suitable type and/or diameter may be used for that operation, the hook remaining the most convenient solution given that it is an instrument designed for that purpose, but nothing prevents the use of other means if it is necessary, thus not limiting the purpose of the present invention). The various calibrating devices can be advantageously realized with different degree of curvature and also more or less marked profile of camber, or this profile can have more or less thickness, a greater thickness decreases the internal diameter of the device/ring, namely that turned towards the finger of the user, so to reduce the size of the ring; therefore depending on the required size a calibrating device will be chosen with a more or less thick profile, more or less bent, in order to obtain the desired technical effect. Depending on the thickness, the calibrating device will therefore protrude more or less from the groove itself.

It should be noted that in some variant embodiments this calibrating device may have a plurality of notches, a single notch or no notch, this without modifying its advantageous function or the scope of protection of the present invention.

Note that the overall weight of the ring is reduced by at least 30% to the benefit of cost and user comfort.

It is immediately evident that this particularly advantageous system 1 is extremely convenient for a user, since the operation of changing the calibrating device is extremely simple; moreover, this calibrating device is particularly advantageous although extremely performing, it is simple to produce and involves the use of fewer materials to the benefit of the cost of production and also the cost of purchase by the customer, making this system accessible to a larger portion of the market, which was precluded by the device previously produced by the applicant.

Again, in a further advantageous way, this device can be made entirely of gold or other precious metal, or yet another metal suitable for the purpose (or even non-metallic material as long as suitable for the purpose), this making it completely resistant to corrosion oxidation and making it completely safe and hypoallergenic for the user, this too more advantageous with respect to the previous solution.

As far as the so-called problems concerning the prior art are concerned, it is immediately evident that such system is completely more performing as it can be realized for any kind of ring, smooth or studded with stones, it does not give any problem from the aesthetic point of view, not going in any way to alter the aesthetics of the annular structure itself.

Furthermore, in a further advantageous way, the calibrating devices can be replaced in case of loss of one of them or in case of deterioration, without any intervention on the ring to the benefit of the owner. Again, as is evident, these devices are completely safe, so that the ring will be firmly tucked into the user's finger, without, however, overtightening the finger in an annoying way.

Furthermore, the internal camber in contact with the finger, thanks to its shape, gives a sensation of comfort.

Finally, this system allows in a particularly advantageous and innovative way to adjust the size of a ring or annular structure up to at least four sizes, but there is nothing to prevent some variants that can include a change of size even larger, beyond the four sizes without departing from the scope of protection of this invention.

It should be noted that the system described here advantageously allows to maintain the concentricity between the external ring structure and the adjustment device, this in a completely advantageous way maintaining the correct fit of the ring on the finger, avoiding problems of discomfort due to incorrect balancing of the same, this also giving aesthetic pleasantness to the system and simplicity of use of the same.

It is therefore clear that the present advantageous and innovative regulating system for rings described here is able to solve all the problems of the prior art just mentioned and is also able to brilliantly solve the technical problems related to the invention described and patented previously by the applicant.

Further variants in materials in which one or more parts of the regulating system as described are realized, variants in which the device does not include the said notches, maintaining however the advantageous characteristics explained above, the presence of one or more holes, passing or not, of any shape, such as any fins, slots etc. made in such a device, the variation of the sizes, the shape of the ring and of the device, the shape of the housing and its extension, etc. are to be considered included in the scope of protection of the present invention as better defined in the attached claims.

What is claimed is:

1. A regulating system for a finger ring, comprising:

an annular outer ring structure having a substantially circular shape forming an opening with and an inner circumference, comprising at least one groove forming most of the length of said inner circumference of said annular outer ring structure, and at least one or more of a plurality of internal calibrating devices substantially in a shape of a single piece circular crown portion, said at least one or more of a plurality of internal calibrating devices being flexible and adapted to engage in said at least one groove in said annular outer ring structure, said at least one or more of a plurality of internal calibrating devices being concentric with said annular outer ring structure, and being completely housed within said annular outer ring structure while maintaining a correct balance and positioning of said finger ring on a user's finger, each of said plurality of internal calibrating devices having different degrees of curvature and bending on an inside part of said internal calibrating device which defines a thickness of said internal calibrating device to modify a diameter of said opening of said annular outer ring structure, said at least one or more of a plurality of internal calibrating devices being interchangeable with said annular outer ring structure, wherein each of said at least one or more of the plurality of internal calibrating devices comprise a plurality of spaced slots on said inside part and in a direction of a thickness of said at least one or more of a plurality of internal calibrating devices to form a flexible structure which is bendable for being inserted into and removed from said at least one groove, and wherein the at least one or more of a plurality of internal calibrating devices comprises an outer surface having a curved profile extending between circumferential edges of said at least one or more of a plurality of internal calibrating devices to match with an inner surface of said at least one groove such that there is no residual space between said outer surface of said at least one or more of a plurality of internal calibrating devices and said inner surface of said at least one groove.

2. The regulating system for a finger ring according to claim 1, wherein said at least one groove runs along the entire length of said inner circumference of said annular outer ring structure.

3. The regulating system for rings according to claim 1, wherein said at least one or more of a plurality of internal calibrating devices is a substantially closed circular crown.

4. The regulating system for rings according to claim 1, wherein said at least one or more of a plurality of internal calibrating devices comprises at least one hole in one or more terminal ends of said internal calibrating device, said at least one hole being suitable for inserting an instrument, such as a hook, to extract said internal calibrating device from said at least one groove.

5. The regulating system for rings according to claim 1, wherein said at least one or more of a plurality of internal calibrating devices is made of gold, platinum, silver or any metallic or non-metallic material.

6. The regulating system for rings according to claim 4, wherein said at least one or more of a plurality of internal calibrating devices engage in said at least one groove said at least one or more of a plurality of internal calibrating devices being easily replaceable.

7. The regulating system for rings according to claim 4, wherein said at least one or more of a plurality of internal calibrating devices remains in place in said at least one groove by means of elastic forcing.

8. The regulating system for rings according to claim 1, wherein said system have annular measurement modifications up to four or more sizes.

* * * * *